US009101806B1

(12) United States Patent
Aguinaldo et al.

(10) Patent No.: US 9,101,806 B1
(45) Date of Patent: Aug. 11, 2015

(54) ADJUSTABLE GOLF CLUB SHAFT AND HOSEL ASSEMBLY

(71) Applicant: CALLAWAY GOLF COMPANY, Carlsbad, CA (US)

(72) Inventors: Homer E. Aguinaldo, Chula Vista, CA (US); James A. Seluga, Carlsbad, CA (US); Denver Holt, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 1 day.

(21) Appl. No.: 14/259,428

(22) Filed: Apr. 23, 2014

Related U.S. Application Data

(63) Continuation of application No. 13/368,569, filed on Feb. 8, 2012, now Pat. No. 8,753,221.

(60) Provisional application No. 61/590,885, filed on Jan. 26, 2012.

(51) Int. Cl.
*A63B 53/02* (2015.01)

(52) U.S. Cl.
CPC ..... *A63B 53/02* (2013.01); *A63B 2053/022* (2013.01); *A63B 2053/023* (2013.01)

(58) Field of Classification Search
None
See application file for complete search history.

(56) References Cited

U.S. PATENT DOCUMENTS

| | | | | | |
|---|---|---|---|---|---|
| 2,425,808 | A * | 8/1947 | Jakosky | 473/246 |
| 5,413,337 | A * | 5/1995 | Goodman et al. | 473/247 |
| 5,513,844 | A * | 5/1996 | Ashcraft et al. | 473/288 |
| 5,603,666 | A * | 2/1997 | Bowe | 473/307 |
| 5,816,927 | A * | 10/1998 | Taylor | 473/131 |
| 5,860,869 | A * | 1/1999 | Duncalf | 473/131 |
| 6,837,800 | B2 * | 1/2005 | Rollinson et al. | 473/244 |
| 7,922,599 | B2 * | 4/2011 | Yamamoto | 473/288 |
| 8,088,019 | B1 * | 1/2012 | Long et al. | 473/245 |
| 8,105,178 | B2 * | 1/2012 | Sander | 473/288 |
| 8,496,540 | B2 * | 7/2013 | Soracco et al. | 473/307 |
| 8,523,701 | B2 * | 9/2013 | Knutson et al. | 473/307 |
| 2013/0116062 | A1 * | 5/2013 | Zimmerman et al. | 473/307 |
| 2013/0178305 | A1 * | 7/2013 | Beno et al. | 473/287 |
| 2013/0281224 | A1 * | 10/2013 | Zabala Scharpp | 473/288 |
| 2014/0256461 | A1 * | 9/2014 | Beach et al. | 473/248 |
| 2015/0045134 | A1 * | 2/2015 | Beno et al. | 473/288 |

FOREIGN PATENT DOCUMENTS

| | | | |
|---|---|---|---|
| GB | 2225959 | A * | 6/1990 |
| JP | 2008284289 | A * | 11/2008 |
| JP | 2009178296 | A * | 8/2009 |

* cited by examiner

*Primary Examiner* — Stephen Blau
(74) *Attorney, Agent, or Firm* — Rebecca Hanovice; Michael A. Catania; Sonia Lari

(57) ABSTRACT

A golf club comprising a hosel and a shaft that is fastened to the hosel at the heel-side of the club is disclosed herein. The golf club includes a wedge inserted into an opening on the heel-side of the hosel, which and retains the shaft within the hosel. In an alternative embodiment, a lever is inserted into an opening in the heel side of the hosel to retain the shaft within the hosel.

19 Claims, 11 Drawing Sheets

ADJUSTABLE GOLF CLUB SHAFT AND HOSEL ASSEMBLY

CROSS REFERENCES TO RELATED APPLICATIONS

The present application is a continuation of U.S. patent application Ser. No. 13/368,569, filed on Feb. 8, 2012, which claims priority to U.S. Provisional Patent Application No. 61/590,885, filed on Jan. 26, 2012.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having an adjustable shaft and hosel assembly that can be adjusted without interacting with the sole of the club head. More specifically, the present invention relates to a golf club shaft and hosel connection assembly that allows a user to adjust the loft, lie, and face angle of the golf club head, either dependently or independently, by loosening the connection between the shaft and hosel via an opening in the side of the hosel.

2. Description of the Related Art

It is known that changing the angle of a golf club shaft with respect to the golf club head will change certain club specifications, including loft angle, lie angle, and face angle. Several types of adjustable golf clubs are currently available on the market. These models allow the user to adjust loft, lie and face angle by adjusting certain golf club components. The components of many of these models are held together by a fastener, usually a bolt or a screw, which is inserted into a sole opening and extends into a hosel bore to engage with the shaft or a shaft sleeve holding the shaft.

This construction, while functional, is not aesthetically pleasing because it includes a large hole in the sole that can disrupt otherwise attractive sole graphics. Furthermore, in order for a user to adjust the shaft angle, the golfer must turn the golf club upside down, with the sole facing up, to disengage the fastener holding the club and the shaft together. It can be difficult for a user to accurately adjust a golf club head when it is in this position, and the likelihood of losing the fastener or other pieces of the hosel assembly increases when there is a hole in the sole and the pieces are located on the underside of the golf club head. The sole-fastener construction also affects the drag, face angle, and overall center of gravity of the club head. The hole in the sole creates unwanted drag when the golf club is swung, and also creates a keel point that can change the face angle of the club.

In view of the above, there is a need for a hosel assembly that permits a golfer to make adjustments to the shaft and hosel of the club through an access point other than the sole.

BRIEF SUMMARY OF THE INVENTION

The present invention relates to an adjustable shaft and hosel assembly that is held together with a fastener inserted into the heel of the golf club.

One aspect of the present invention is a golf club head comprising a hosel comprising a hosel bore and a heel-side opening, the hosel bore comprising an internal flange, a shaft sleeve comprising a shaft bore, a locking piece comprising a stem and a ledge, and a fastener, at least part of which is sized to fit within the heel-side opening, wherein the shaft sleeve and the locking piece fit within the hosel bore, and wherein the fastener fits within the side opening between the ledge and the flange and fixes the shaft sleeve to the hosel. The golf club head may further comprise a face component with which the hosel is integrally formed. In another embodiment, it may further comprise a washer encircling the stem and abutting an upper surface of the flange. In some embodiments, the locking piece may be integrally formed with the shaft sleeve; in others, the golf club head may further comprise a connection piece that connects the locking piece to the shaft sleeve.

In some embodiments, the fastener may be a wedge comprising a slot sized to releasably receive the stem and an upper surface that is non-parallel with a lower surface. In some of these embodiments, the hosel bore may comprise a first screw bore, the wedge may comprise a second screw bore, and a screw may engage the first and second screw bores to releasably secure the wedge to the hose. The wedge may be composed of one or more materials, including a non-metal material. In some embodiments, the internal flange may have an angled lower surface that is parallel with the upper surface of the wedge.

In other embodiments, the fastener may be a lever comprising a lever handle and a lever head, and wherein the lever head comprises a stem-receiving recess, an upper surface having a first length, and a lower surface having a second length that is greater than the first length. The head of the lever may further comprise at least one guidance pin, which may engage one or more ledges disposed within the hosel opening. In some further embodiments, the hosel may further comprise a recessed area proximate the hosel opening sized to receive the lever handle.

In some embodiments, the golf club head of claim may include a first tubular adjustment piece having non-parallel upper and lower surfaces, the first tubular adjustment piece encircling at least a portion of the shaft sleeve and abutting an upper surface of the hosel. These embodiments may further comprise a second tubular adjustment piece having non-parallel upper and lower surfaces, the second tubular adjustment piece encircling at least a portion of the shaft sleeve and disposed proximate the first tubular adjustment piece.

Another aspect of the present invention is a driver-type golf club head comprising a metal face component comprising a striking face, a return portion, a hosel, a heel side, and a toe side, a metal sole, a non-metal crown, a shaft sleeve comprising a shaft bore, a connection piece, a stem, and a ledge, a washer, and a wedge comprising an upper surface, a lower surface that is non-parallel to the upper surface, and a slotted recess, wherein the hosel comprises a heel-side opening and a hosel bore comprising an angled internal flange, wherein the shaft sleeve fits within the hosel bore such that the connection piece is disposed above the internal flange, the stem extends through the internal flange, and the ledge is disposed below the internal flange, wherein the washer encircles the stem and abuts an upper surface of the ledge, and wherein the wedge fits within the heel-side opening such that the upper surface abuts the internal flange, the lower surface abuts the washer, and the slotted recess receives the stem. In some embodiments, the face component may be integrally formed with the sole, the shaft sleeve may be composed of a lightweight metal alloy, and the wedge may be composed of a polymeric material. In other embodiments, the driver-type golf club head may further comprise a screw that engages a first screw bore in the wedge and a second screw bore in the hosel opening to removably fix the wedge to the hosel.

Yet another aspect of the present invention is a golf club head comprising a hosel comprising a keyed hosel mouth, a hosel bore having an angled, internal flange, and a heel-side opening having a first screw bore disposed perpendicular to the hosel bore, a keyed fitting member sized to fit within the keyed hosel mouth, a shaft sleeve comprising a shaft bore, a keyed portion sized to fit within the fitting member, a stem, and a ledge, a first tubular adjustment piece having non-parallel upper and lower surfaces, the first tubular adjustment piece encircling at least a portion of the shaft sleeve and abutting the hosel mouth, a wedge comprising an upper surface, a lower surface that is non-parallel to the upper surface, a slotted recess, and a second screw bore, and a screw, wherein the keyed fitting member can move along a first axis within the hosel mouth, wherein the keyed portion of the shaft sleeve can move along a second axis within the fitting member, wherein the first axis is approximately perpendicular to the second axis, wherein rotating the first tubular adjustment piece around the shaft sleeve causes the shaft sleeve to move along at least one of the first and second axes within the hosel bore, wherein the shaft sleeve fits within the hosel bore such that the ledge is disposed below the internal flange, wherein the wedge fits within the heel-side opening such that the upper surface is disposed proximate the internal flange, the lower surface is disposed proximate the ledge, and the slotted recess receives the stem, and wherein the screw engages the first screw bore and the second screw bore and removably secures the wedge within the heel-side opening. In some embodiments, the golf club head may further comprise a washer comprising a flat upper surface and a convex lower surface, wherein the washer encircles the stem, wherein the lower surface abuts an upper surface of the ledge, and wherein the upper surface abuts the wedge. The hosel may be composed of a first metal alloy having a first density, the shaft sleeve and the first tubular adjustment piece may be composed of a second metal alloy having a second density that is less than the first density, and the fitting member and wedge may be composed of a non-metal material.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
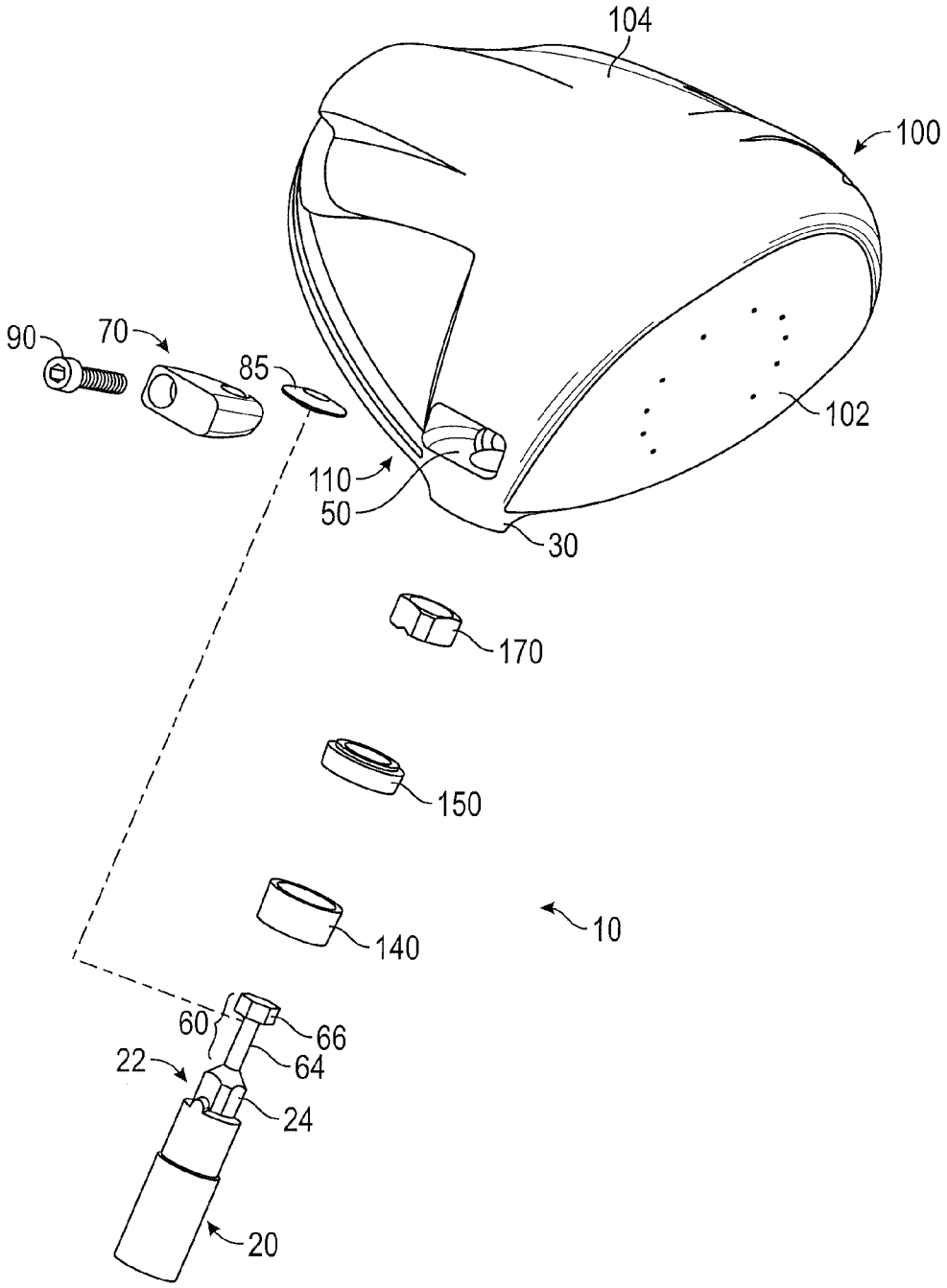
FIG. 1 is an exploded view of the preferred embodiment of the present invention.
Figure 2:
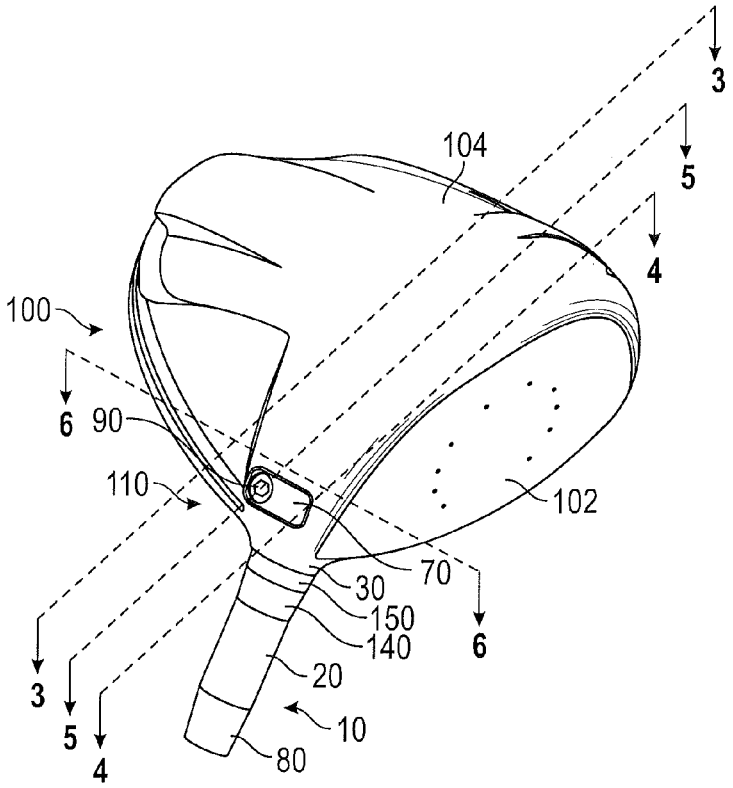
FIG. 2 is a side, perspective view of the embodiment shown in FIG. 1 in assembled form.
Figure 3:
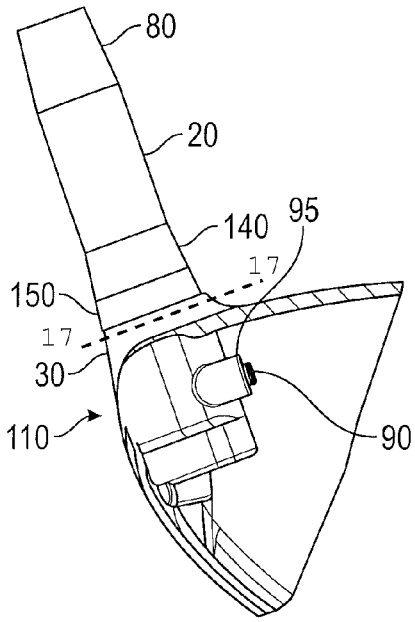
FIG. 3 is a cross-section view of the hosel assembly shown in FIG. 2 along line 3-3.

The present invention allows golfers to adjust, or remove, the shafts on their golf clubs by accessing a fastener located in the heel 110 of the golf club head 100 instead of in the sole. The present invention may also be used by golfers who do not wish to make angular adjustments to their clubs, but instead want a means to easily remove and replace their club shafts. The embodiments of the present invention may be used with any type of golf club head, including woods, hybrids, irons, and putters, though in the preferred embodiment the present invention is used in connection with a driver head having a face 102, sole 104, and crown 106.

A preferred embodiment of the present invention is shown in FIGS. 1-7. The hosel assembly 10 of the preferred embodiment includes a shaft sleeve 20, a hosel 30, and a wedge piece 70. The hosel 30 of the present invention preferably is integrally formed with one or more parts of the golf club head 100, such as the face 102 or sole 104, but may be a separately formed piece that is bonded, welded, or mechanically fixed to the head 100 after the head 100 is formed. The hosel 30 includes a hosel bore 32 sized to receive the shaft sleeve 20, an internal flange 34, which preferably has an angled lower surface, disposed within the hosel bore 32 such that the bore 32 has a narrowed region 33, and a hosel opening 50 on the heel 110 of the golf club head 100 that provides access to the hosel bore 32. The wedge piece 70 is sized to fit within the hosel opening 50 and abut the angled side of the flange 34, and acts as the fastener that holds the assembly 10 together. The wedge piece 70 is preferably retained within the hosel opening 50 with a screw 90, which engages a screw bore 95 that is disposed perpendicular to the hosel bore 32 and is accessible via the hosel opening 50. The screw bore 95 preferably is integrally formed with the hosel 30. In alternative embodiments, the wedge piece 70 may be retained within the hosel opening 50 via friction with other features of the assembly 10 (such as the flange 34 and hosel bore 32), a removable adhesive, or another mechanism so that no screw 90 is necessary.

The shaft sleeve 20 of the preferred embodiment includes a sleeve bore 21 sized to receive a shaft (not shown) and a lower region 22 with a connection piece 24. In an alternative embodiment, the shaft sleeve 20 may be integrally formed with the shaft. The assembly 10 may further include a ferrule 80 disposed above the shaft sleeve 20, as shown in FIGS. 2-6. The connection piece 24 of the shaft sleeve 20 connects to a locking piece 60, which includes a T-shaped stem 64 and ledge 66 combination, shown in FIGS. 1, 4, and 6. In the preferred embodiment, both the stem 64 and the ledge 66 fit through the region 33 of the hosel bore 32 narrowed by the flange 34. The locking piece 60 preferably is integrally formed with the shaft sleeve 20, and the stem 64 is, in the preferred embodiment, encircled by a washer 85 to ensure a proper fit between the various pieces of the assembly 10. The washer 85 preferably includes the friction-reducing curvature described in U.S. patent application Ser. Nos. 13/311,319; 13/326,156; 13/332,846; and 13/367,045, the disclosure of each of which is hereby incorporated by reference in its entirety herein, and the ledge 66 may have similar, mating curvature to further avoid unwanted friction.

In an alternative embodiment, the narrowed region 33 of the hosel bore 32 permits only the stem 64 to fit through, while the ledge 66 has a diameter that is too large to fit through the narrowed region 33. In this embodiment, the locking piece 60 is a separate part that is connected to the shaft sleeve 20 during construction of the hosel assembly 10. The locking piece 60 may be affixed to the shaft sleeve 20 in many ways. For example, in one embodiment, the connection piece 24 is an internally threaded nut, and an upper region of the stem 64 has internal threads that are securely gripped by the connection piece 24 when the connection piece 24 is screwed onto the stem 64. In alternative embodiments, the connection piece 24 may be a clip that grips the upper region of the stem 64, or the connection piece 24 may be bonded to the stem 64 with an adhesive material.

The separate locking piece 60 hosel assembly 10 embodiments may be assembled in many ways. One method of doing so involves the use of a separately formed hosel 30 in connection with a desired golf club head 100. In this method, the locking piece 60 is inserted into the lower region of the hosel bore 32, below the flange 34, before the hosel 30 is affixed to the rest of the golf club head. The flange 34 may be a separate piece that is added after the locking piece 60 is disposed within the hosel bore 32 by threading the stem 64 of the locking piece 60 through the flange 34. When the hosel 30, which contains the flange 34, is affixed to the golf club head, the locking piece 60 is trapped within the lower region of the hosel bore 32 with the stem 64 passing through the narrowed region 33 of the hosel bore 32. The shaft sleeve 20, which may be affixed to, or integrally formed with, a shaft, is then inserted into the upper region of the hosel bore 32, above the flange 34, and the connection piece 24 engages the upper portion of the stem 64. The connection between the stem 64 and the connection piece 24 is preferably semi-permanent, but in some embodiments the connection piece 24 is permanently affixed to the stem 64 of the locking piece 60 so that the shaft sleeve 20 cannot be disassembled from the hosel 30.

Figure 4:
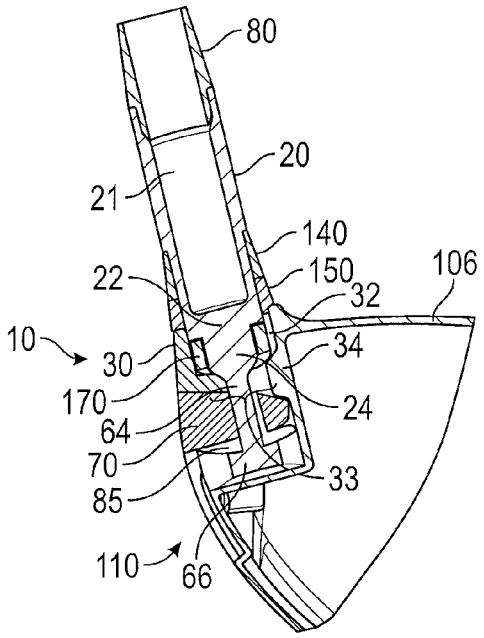
FIG. 4 is a cross-section view of the hosel assembly shown in FIG. 2 along line 4-4.
Figure 5:
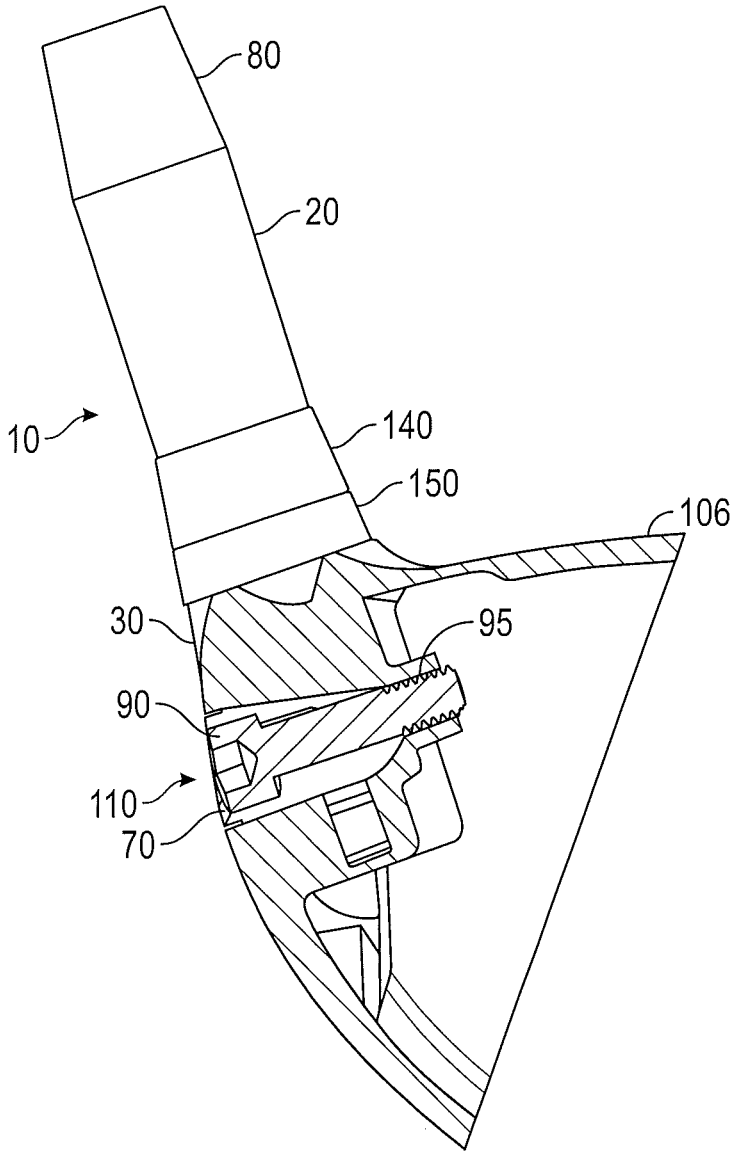
FIG. 5 is a cross-section view of the hosel assembly shown in FIG. 2 along line 5-5.
Figure 6:
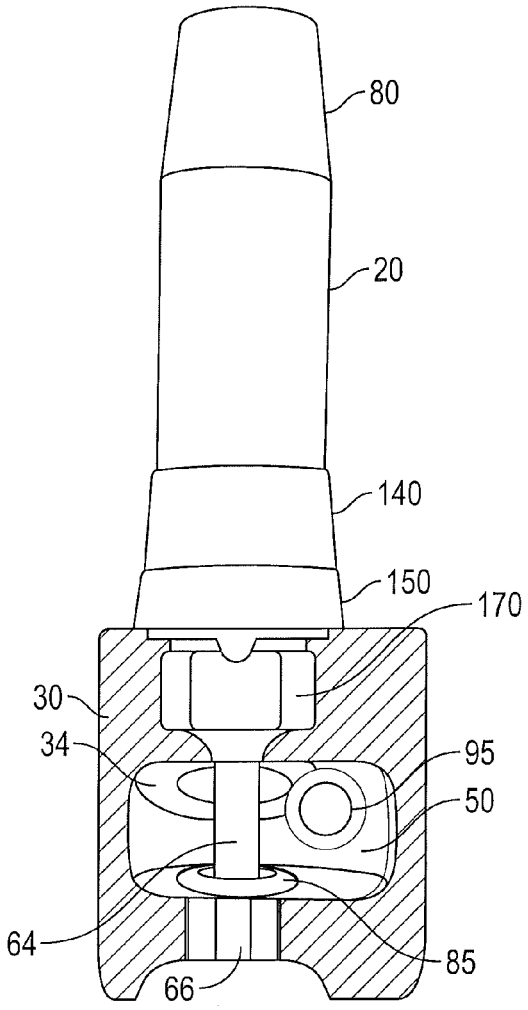
FIG. 6 is a cross-section view of the hosel assembly shown in FIG. 2 along line 6-6 without the wedge and with a see-through hosel.

With respect to each of the embodiments discussed above, once the shaft sleeve 20 is fully inserted into the hosel such that the stem 64 is threaded through the narrowed region 33 and the ledge 66 is disposed within the hosel opening 50 as shown in FIGS. 4, 5, and 6, the hosel assembly 10 can be adjusted to attain a desired lie, loft, and/or face angle for the golf club head 100. The shaft sleeve 20 can be moved about within the hosel bore 32 using a number of different mechanisms, including those disclosed in U.S. patent application Ser. Nos. 13/311,319; 13/326,156; 13/332,846; and 13/367,045.

For example, FIGS. 1-6 and 17-20 show the present invention in combination with the fitting member 170, keyed hosel mouth 132, and shims 140, 150 disclosed in U.S. patent application Ser. No. 13/367,045. As shown in FIGS. 17-20, the lower region 22 of the shaft sleeve 20 fits within the fitting member 170 and can move within the fitting member 170 along a first axis 81. The movement of the shaft sleeve 20 and the fitting member 170 is facilitated through the inclusion of pins 23, 175 protruding from external surfaces of the lower region 22 of the shaft sleeve 20 and the fitting member 170. Similarly, the fitting member 170 can move within the keyed hosel mouth 132 along a second axis 82. The second axis 82 acts as a pivot axis for the shaft sleeve 20, while the first axis 81 acts as a pivot axis for the fitting member 170. The two axes 81, 82 are disposed at 90° angles with respect to one another, and provide full, 360° rotation capability for the shaft sleeve 20, and thus the shaft (not shown), with respect to the golf club head 100. When the shaft sleeve 20 is assembled with the fitting member 170, its pins 23 rest within arcuate notches 176 in the sides of the fitting member 170. The pins 175 of the fitting member 170 rest within arcuate notches 134 in the side of the hosel 30.

Figure 21:
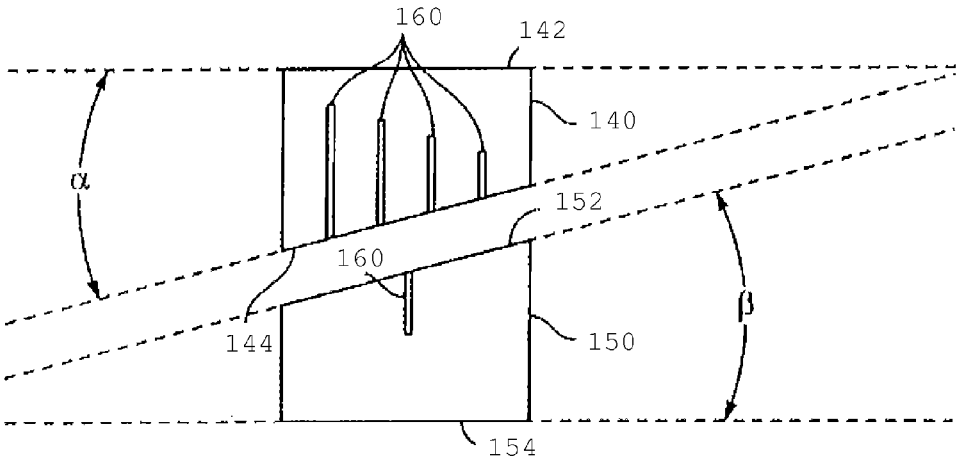
FIG. 21 is a side plan view of the upper and lower shims of the embodiment shown in FIG. 1.

As shown in FIG. 21, the shims 140, 150 each have non-parallel (tapered), mating upper surfaces 142, 152 and lower surfaces 144, 154 and work together by moving the shaft sleeve 20, and thus an installed shaft (not shown), so that it has a desired angle with respect to the hosel 30 and thus the golf club head 100. In other words, the shims 140, 150 allow a user to rotate the shaft sleeve 20, and thus the shaft, from 0° to a desired maximum degree angle with respect to a shaft reference axis. The angle $\alpha$ between the upper and lower surfaces 142, 144 of the upper shim 140 may be equivalent to the angle $\beta$ between the upper and lower surfaces 152, 154 of the lower shim 150, or they may differ. The upper surface 142 of the upper shim 140 may be parallel with the lower surface 154 of the lower shim 150, or these surfaces 142, 154 may be non-parallel. The shims 140, 150 preferably also include one or more angle markings 160 on their sides. In an alternative embodiment, the hosel assembly 10 of the present invention may be adjusted using the tool shown in FIG. 13 of U.S. patent application Ser. No. 13/311,319.

Figure 7A:
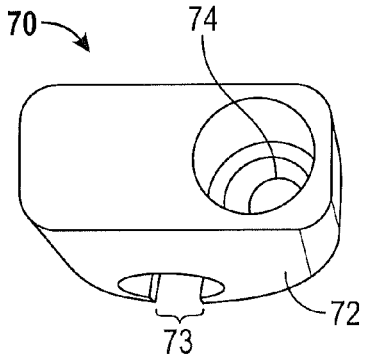
FIGS. 7A-C are perspective views of the wedge shown in FIG. 1.
Figure 7B:
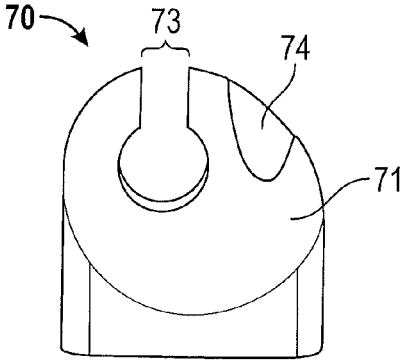
Figure 7C:
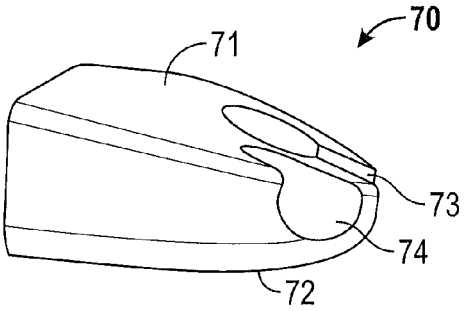
Figure 8:
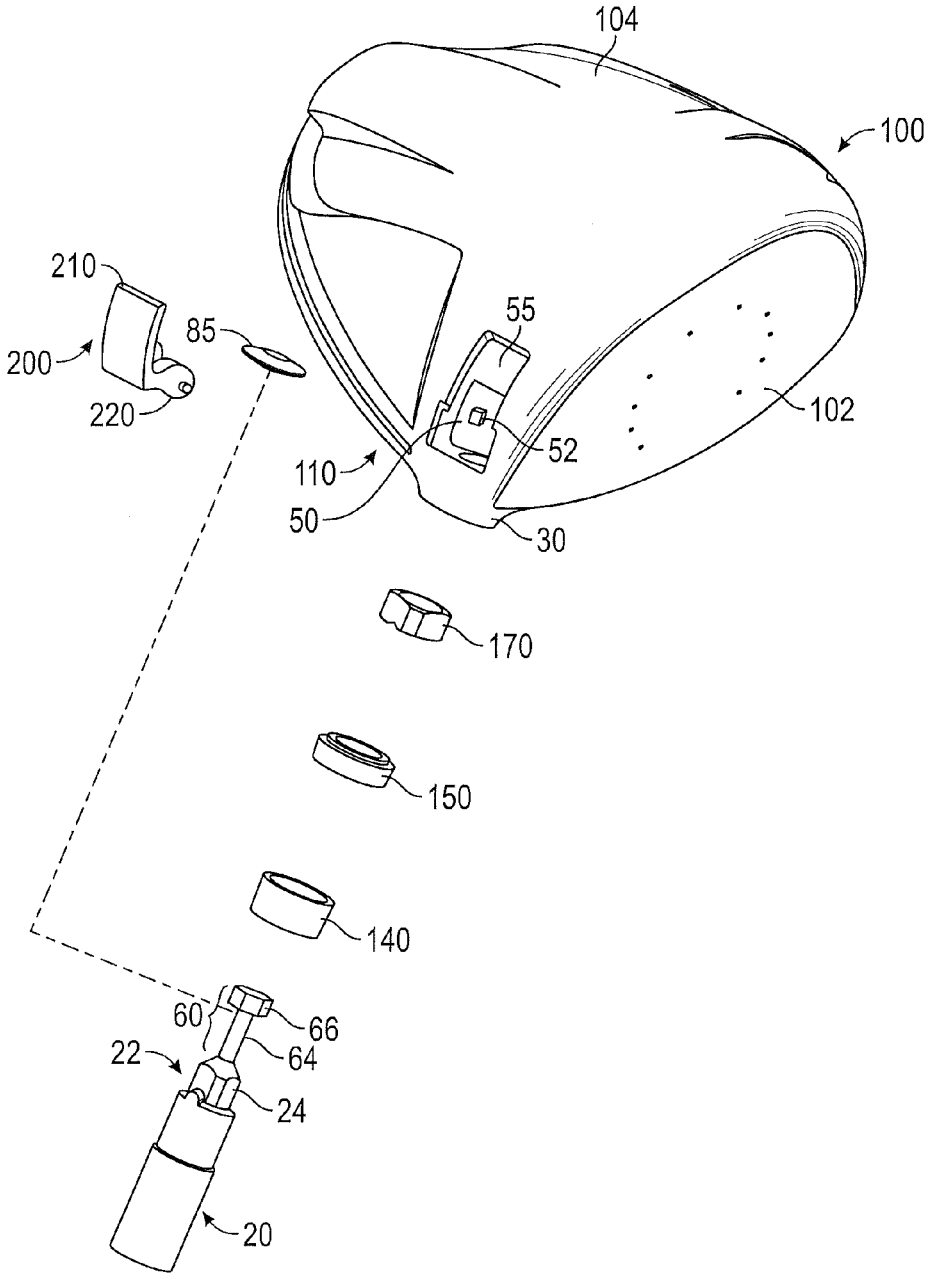
FIG. 8 is an exploded view of another embodiment of the present invention.

Once the user has selected a desired angle between the shaft sleeve 20 and the golf club head 100, the wedge 70 is inserted through the hosel opening 50 to fix the shaft sleeve 20 in place with respect to the hosel 30, and thus the golf club head 100. The wedge 70, which is shown in greater detail in FIGS. 7A-7C, comprises at least one upper surface 71 that is non-parallel with at least one lower surface 72, a stem-receiving opening 73, and a screw bore 74. As shown in FIG. 4, when the wedge 70 is inserted into the hosel opening 50, the upper surface 71 of the wedge 70 presses against the lower surface of the flange 34, and the lower surface 72 presses against the washer 85, which rests against an upper surface of the ledge 66. The stem-receiving opening 73, which preferably is keyed as shown in FIGS. 7A-7C, receives the stem 64 of the locking piece 60 and prevents the locking piece 60, and thus the shaft sleeve 20, from moving about within the hosel bore 32.

When the wedge 70 is fully inserted in the hosel opening 50, the screw bore 74 of the wedge 70 lines up with the screw bore 95 of the hosel 30, and the wedge 70 can be secured within the hosel opening 50 with the screw 90. If a user wishes to remove the wedge 70, the screw 90 can be removed with a screwdriver and the wedge 70 can be retrieved from the hosel opening 50. If the user wishes to adjust the overall weight of the golf club head 100 or the center of gravity of the club head 100, he can remove the wedge 70 and replace it with another wedge 70 having a different weight, density, and/or composition of materials. For example, a wedge 70 formed of a polymeric material can be replaced with a wedge 70 formed of a metal alloy such as steel, titanium, and/or tungsten. In an alternative embodiment, the user can forego the screw 90 and permanently bond the wedge 70 within the hosel opening 50 if he wishes to make the new shaft angle permanent.

Another embodiment of the present invention is shown in FIGS. 8-16. This assembly 10 includes the shaft sleeve 20, locking piece 60, heel 110 side hosel opening 50, hosel 30 and hosel bore 32, and washer 85 described herein with respect to the preferred embodiment. Instead of a wedge 70, however, this embodiment employs a lever 200 having a handle 210 and a head 220 to act as a fastener and prevent the shaft sleeve 20 from moving about within the hosel bore 32. Furthermore, though the hosel bore 32 has a flange 34, the flange 34 does not have to be angled but instead has a lower surface that is perpendicular to the axis of the hosel bore 32. The heel 110 surface of the hosel 30 of this embodiment also includes a shallow, recessed area 55 proximate the hosel opening 50 that receives the handle 210 of the lever when it is fully engaged with the hosel assembly 10, thus allowing the lever 200 to be flush with the golf club head 100 and not protrude in an unsightly way.

Figure 9A:
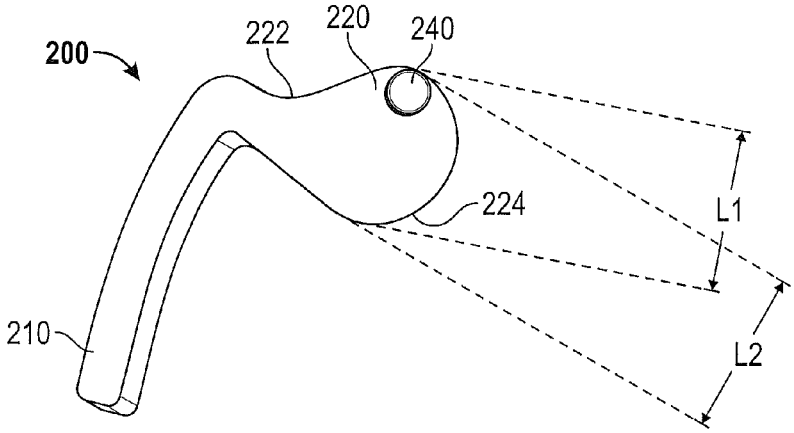
FIGS. 9A-B are perspective views of the lever shown in FIG. 8.
Figure 9B:
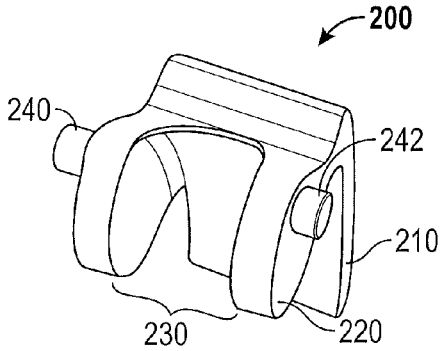

The lever 200 is shown in greater detail in FIGS. 9A-B. The head 220 of the lever 200 has an upper surface 222 with an overall length L1 that is less than the overall length L2 of a lower surface 224, a stem-receiving recess 230 sized to fit around the stem 64 of the locking piece 60, and guide pins 240, 242 extending from two opposing sides. L1 is preferably approximately 0.352 inches, while L2 is approximately 0.358 inches. The hosel opening 50 comprises at least one internal ledge 52 against which the guide pins 240, 242 rest when the head 220 of the lever 200 is inserted into the hosel opening 50. In an alternative embodiment, the head 220 may have features other than guide pins 240, 242 to ensure that it sits properly within the hosel opening 50.

Figure 10:
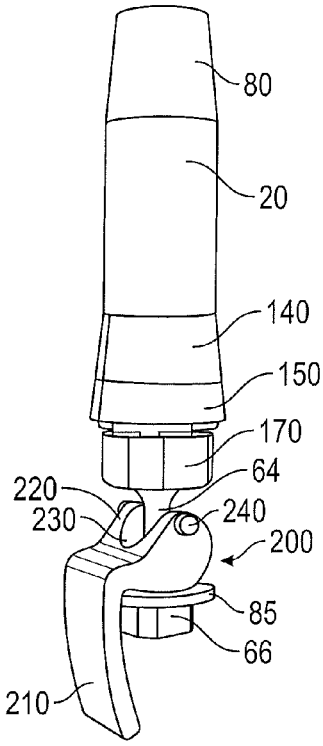
FIG. 10 is a side, perspective view of the hosel assembly shown in FIG. 8 without the hosel and the head.

As shown in FIG. 10, the head 220 of the lever 200 receives the stem 64 within the stem-receiving recess 230, and the lower surface 224 rests against the washer 85 and presses the washer 85 against the ledge 66 of the locking piece. As with the wedge 70 described in connection with the preferred embodiment, if a user wishes to adjust the overall weight of the golf club head 100 or the center of gravity of the club head 100, he can replace the lever 200 with another having a different weight, density, and/or composition of materials. For example, a lever 200 formed of a polymeric material can be replaced with a lever 200 formed of a metal alloy such as steel, titanium, and/or tungsten.

FIGS. 11-16 illustrate how the lever 200 functions and secures the shaft sleeve 20 within the hosel 30. Before doing so, however, the shaft sleeve 20 angle can be adjusted with respect to the golf club head 100 using a number of different mechanisms, including those disclosed in U.S. patent application Ser. Nos. 13/311,319; 13/326,156; 13/332,846; and 13/367,045. For example, FIGS. 8 and 10-21 show the present invention in combination with the fitting member 170, keyed hosel mouth 132, and shims 140, 150 disclosed in Ser. No. 13/367,045. In an alternative embodiment, the hosel assembly 10 of the embodiment shown in FIGS. 8-16 may be adjusted using the tool shown in FIG. 13 of U.S. patent application Ser. No. 13/311,319.

Figure 11:
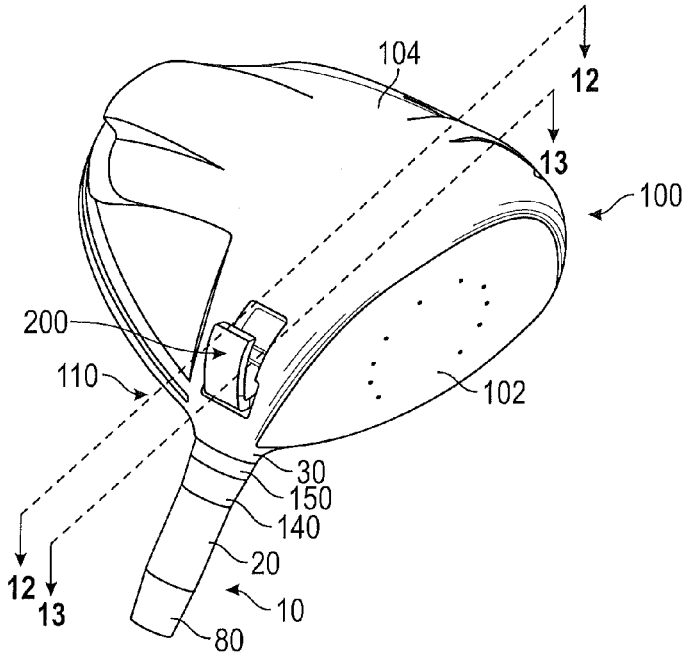
FIG. 11 is a side, perspective view of the embodiment shown in FIG. 8 in a first assembled form.
Figure 12:
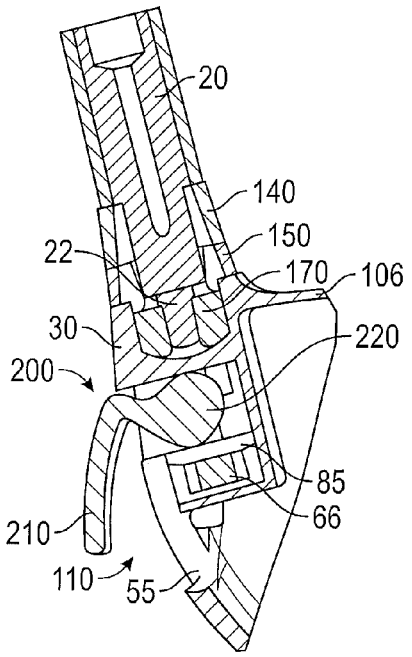
FIG. 12 is a cross-section view of the hosel assembly shown in FIG. 11 along line 12-12.
Figure 13:
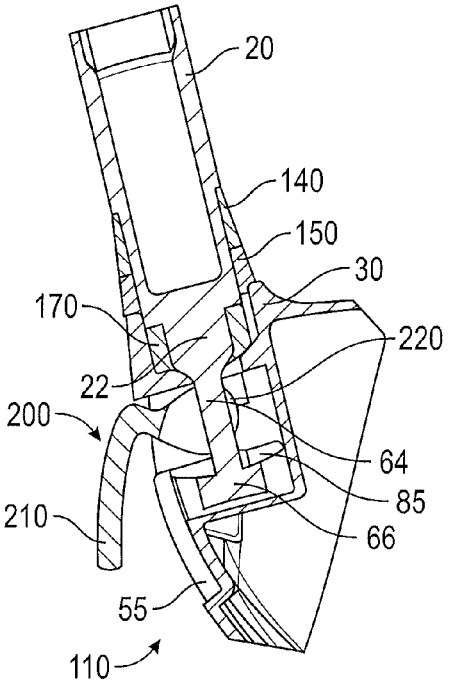
FIG. 13 is a cross-section view of the hosel assembly shown in FIG. 11 along line 13-13.

Once the shaft sleeve 20 angle with respect to the golf club head 100 is selected, the head 220 of the lever 200 is inserted into the hosel opening 50 such that the handle 210 protrudes from the heel 110 of the club head 100, as shown in FIGS. 11-13. In this configuration, the head 220 of the lever 200 engages the stem 64 of the locking piece 60 and rests against the washer 85, and thus the ledge 66 of the locking piece 60, but does not press against the flange 34 of the hosel bore 32 because the vertical length of the head 220 in this position is not long enough to reach the flange 34. In this configuration, the guide pins 240, 242 may also rest against the internal ledges of the hosel opening 50.

Figure 14:
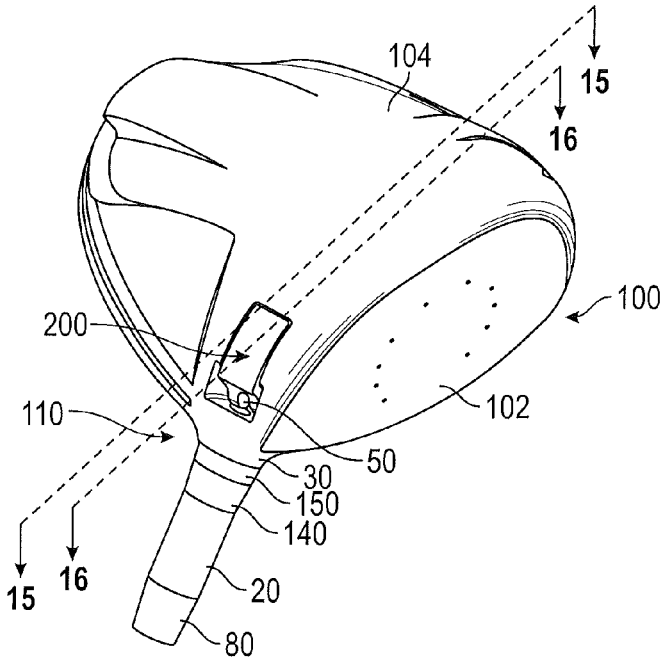
FIG. 14 is a side, perspective view of the embodiment shown in FIG. 8 in a second assembled form.
Figure 15:
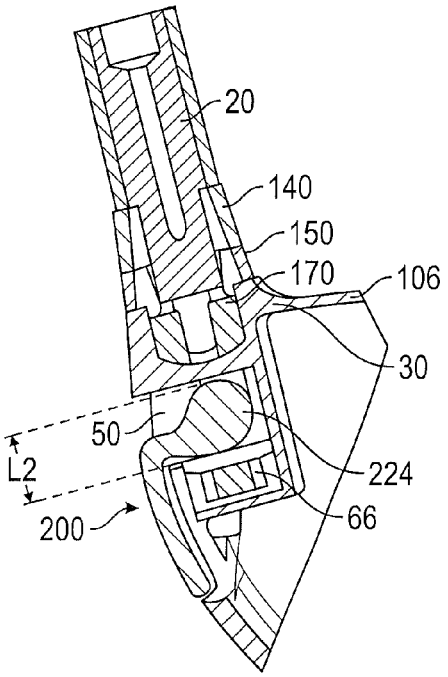
FIG. 15 is a cross-section view of the hosel assembly shown in FIG. 14 along line 15-15.
Figure 16:
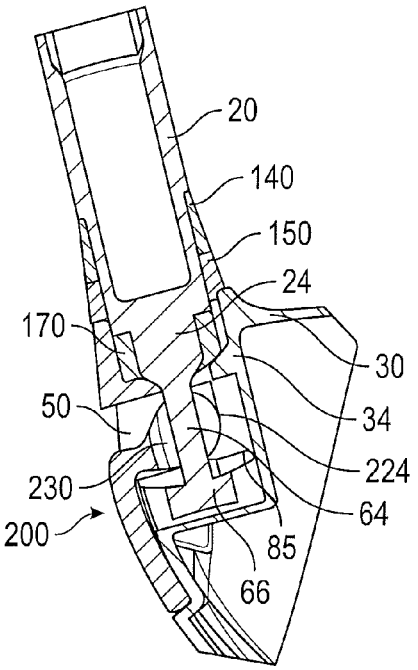
FIG. 16 is a cross-section view of the hosel assembly shown in FIG. 14 along line 16-16.
Figure 17:
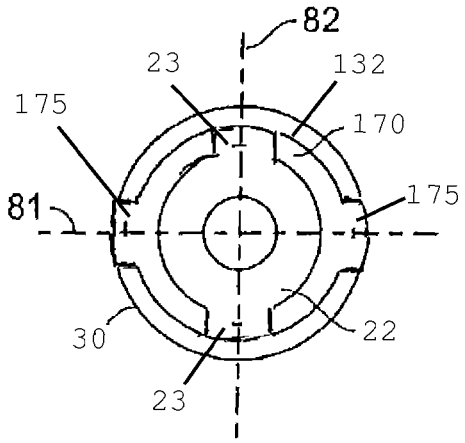
FIG. 17 is a cross-sectional view of the hosel assembly shown in FIG. 3 along lines 17-17.
Figure 18:
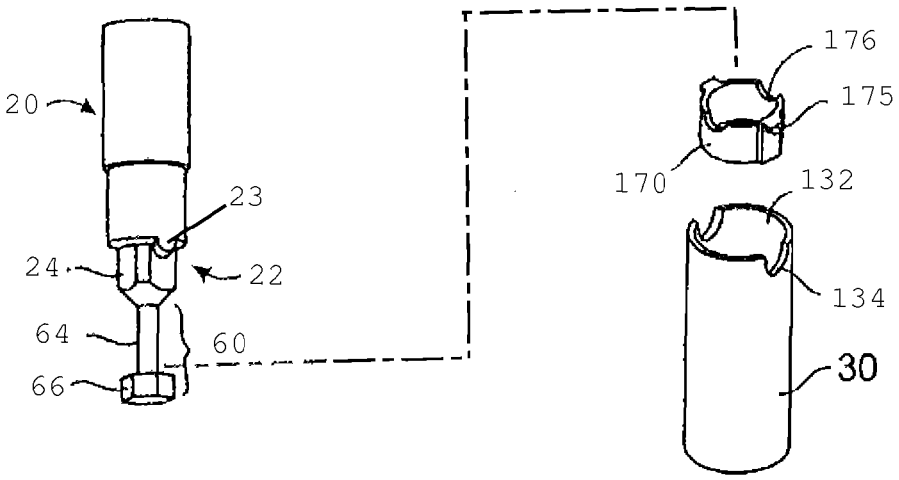
FIG. 18 is an exploded view of the shaft sleeve shown in FIG. 1 engaged with the fitting member and hosel.
Figure 19:
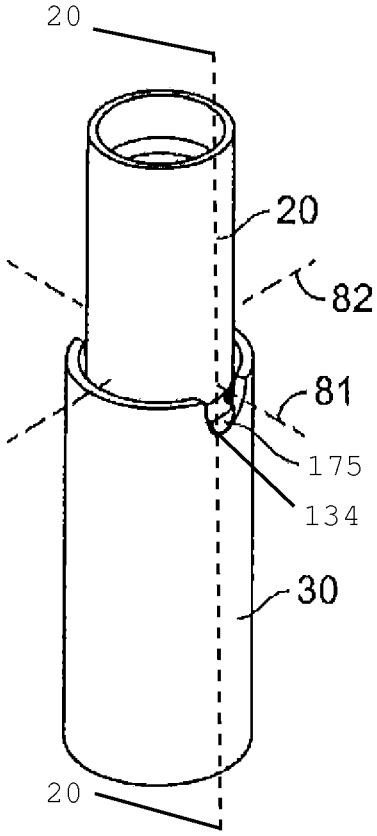
FIG. 19 is an assembled view of the embodiment shown in FIG. 18.
Figure 20:
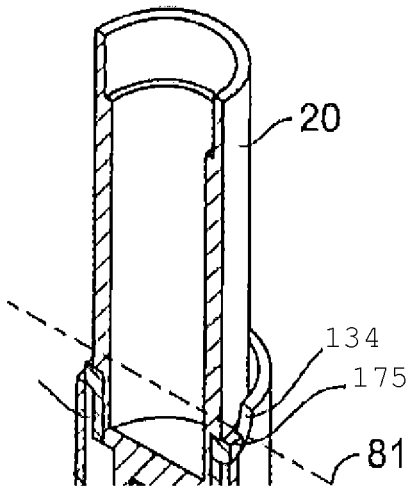
FIG. 20 is a cross-sectional view of the embodiment shown in FIG. 19 along lines 20-20.

To fix the shaft sleeve 20 securely within the hosel 30, the handle 210 of the lever 200 is then pressed toward the heel 110 of the golf club head 100 as shown in FIGS. 14-16, and is received in the recessed area 55 proximate the hosel opening 50 so that it is flush with the club head. Pressing the handle 210 of the lever 200 in this matter causes the head 220 to rotate so that the lower surface 224, which has a longer length L2 than that of the upper surface 222, is disposed vertically and presses against both the washer 85 and the flange 34 inside the hosel bore 32. The force exerted by the head 220 of the lever 200 in this position prevents the locking piece 60, and thus the shaft sleeve 20, from moving with respect to the golf club head 100.

The embodiments disclosed herein may be made of any number of materials, including those material compositions disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein. For example, the face, sole, and hosel 30 may be integrally cast from a metal alloy such as titanium, while the crown may be formed of a composite material. The other pieces of the invention may also be composed of any kind of material. For example, the shaft sleeve 20 and locking piece 60 may be made of a lightweight metal alloy, while the wedge 70, lever 200, fitting member 170, and shims 140, 150 may be made of a polymeric or composite material. In alternative embodiments, these pieces may be composed of one or more metal alloys.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a hosel comprising a hosel bore and a heel-side opening, the hosel bore comprising an internal flange;

a shaft sleeve comprising a shaft bore;

a locking piece comprising a ledge; and a lever comprising a lever head, wherein the lever head comprises an upper surface having a first length and a lower surface having a second length that is greater than the first length, wherein the shaft sleeve and the locking piece fit within the hosel bore, and wherein the lever head fits within the side opening between the ledge and the flange and fixes the shaft sleeve to the hosel.

2. The golf club head of claim 1, wherein the locking piece comprises a stem.

3. The golf club head of claim 2, wherein the lever head comprises a stem-receiving recess.

4. The golf club head of claim 2, further comprising a washer, wherein the washer encircles the stem and abuts an upper surface of the ledge.

5. The golf club head of claim 1, wherein the lever comprises a lever handle, and wherein the hosel comprises a recessed area proximate the heel-side opening sized to receive the lever handle.

6. The golf club head of claim 1, further comprising a face component, wherein the hosel is integrally formed with the face component.

7. The golf club head of claim 1, further comprising a connection piece, wherein the connection piece connects the locking piece to the shaft sleeve.

8. The golf club head of claim 1, wherein the lever head further comprises at least one guidance pin, and wherein the hosel opening comprises at least one ledge shaped to engage the at least one guidance pin.

9. The golf club head of claim 1, further comprising a first tubular adjustment piece having non-parallel upper and lower surfaces, the first tubular adjustment piece encircling at least a portion of the shaft sleeve and abutting an upper surface of the hosel.

10. The golf club head of claim 9, further comprising a second tubular adjustment piece having non-parallel upper and lower surfaces, the second tubular adjustment piece encircling at least a portion of the shaft sleeve and disposed proximate the first tubular adjustment piece.

11. A driver-type golf club head comprising:

a metal face component comprising a striking face, a return portion, a hosel, a heel side, and a toe side;

a metal sole;

a crown;

a shaft sleeve comprising a shaft bore, a stem, and a ledge;

a washer; and a lever comprising a lever handle and a lever head;

wherein the lever head comprises an upper surface, a stem-receiving recess, and a lower surface, wherein the hosel comprises a heel-side opening and a hosel bore comprising an internal flange, wherein the shaft sleeve fits within the hosel bore such that the stem extends through the internal flange and the ledge is disposed below the internal flange, wherein the washer encircles the stem and abuts an upper surface of the ledge, and wherein the lever head fits within the heel-side opening such that the upper surface abuts the internal flange and the lower surface abuts the washer.

12. The driver-type golf club head of claim 11, wherein the face component is integrally formed with the sole, wherein the shaft sleeve is composed of a lightweight metal alloy, and wherein the lever is composed of a polymeric material.

13. The driver-type golf club head of claim 11, wherein the lever head further comprises at least one guidance pin, and wherein the hosel opening comprises at least one ledge shaped to engage the at least one guidance pin.

14. A golf club head comprising:

a hosel comprising a keyed hosel mouth, a hosel bore having an internal flange, and a heel-side opening;

a keyed fitting member sized to fit within the keyed hosel mouth;

a shaft sleeve comprising a shaft bore, a keyed portion sized to fit within the fitting member, a stem, and a ledge;

a first tubular adjustment piece having non-parallel upper and lower surfaces, the first tubular adjustment piece encircling at least a portion of the shaft sleeve and abutting the hosel mouth; and a lever comprising a lever handle and a lever head, wherein the lever head comprises an upper surface and a lower surface, wherein the keyed fitting member can move along a first axis within the hosel mouth, wherein the keyed portion of the shaft sleeve can move along a second axis within the fitting member, wherein rotating the first tubular adjustment piece around the shaft sleeve causes the shaft sleeve to move along at least one of the first and second axes within the hosel bore, wherein the shaft sleeve fits within the hosel bore such that the ledge is disposed below the internal flange, and wherein the lever head fits within the heel-side opening such that the upper surface is disposed proximate the internal flange and the lower surface is disposed proximate the ledge.

15. The golf club head of claim 14, further comprising a washer comprising a flat upper surface and a convex lower surface, wherein the washer encircles the stem, wherein the lower surface abuts an upper surface of the ledge, and wherein the upper surface abuts the lever head.

16. The golf club head of claim 14, wherein the hosel is composed of a first metal alloy having a first density, the shaft sleeve and the first tubular adjustment piece are composed of a second metal alloy having a second density that is less than the first density, and the fitting member and lever are composed of a non-metal material.

17. The golf club head of claim 14, wherein the first axis is approximately perpendicular to the second axis.

18. The golf club head of claim 14, wherein the lever head comprises a stem-receiving recess.

19. The golf club head of claim 14, wherein the lever head comprises at least one guidance pin, and wherein the hosel opening comprises at least one ledge shaped to engage the at least one guidance pin.

* * * * *